US008561506B2

(12) United States Patent
Buchanan et al.

(10) Patent No.: US 8,561,506 B2
(45) Date of Patent: Oct. 22, 2013

(54) HAND OPERATED GRIPPING TOOL

(75) Inventors: Nigel Alexander Buchanan, Fife (GB); Seamus Duffy, Lanesborough (IE)

(73) Assignee: American Grease Stick Company, Muskegon Heights, MI (US)

( * ) Notice: Subject to any disclaimer, the term of this patent is extended or adjusted under 35 U.S.C. 154(b) by 0 days.

(21) Appl. No.: 12/261,525

(22) Filed: Oct. 30, 2008

(65) Prior Publication Data

US 2009/0178518 A1 Jul. 16, 2009

Related U.S. Application Data

(63) Continuation-in-part of application No. 12/281,548, filed as application No. PCT/GB2007/000745 on Mar. 5, 2007, now abandoned.

(30) Foreign Application Priority Data

Mar. 3, 2006 (IE) ..... 2006/0158
Oct. 30, 2007 (GB) ..... 0721292.1

(51) Int. Cl.
*B25B 7/04* (2006.01)
*B25B 7/12* (2006.01)

(52) U.S. Cl.
USPC ..... 81/407; 81/378

(58) Field of Classification Search
USPC ..... 81/408, 352–356, 363, 347, 364–366, 81/373, 376, 378–380, 407, 427, 409–414
See application file for complete search history.

(56) References Cited

U.S. PATENT DOCUMENTS

| | | | | |
|---|---|---|---|---|
| 389,666 | A * | 9/1888 | Reagan | 81/408 |
| 726,013 | A * | 4/1903 | Aue | 81/408 |
| 988,656 | A * | 4/1911 | Peck | 81/334 |
| 1,106,518 | A | 8/1914 | Matti | |
| 1,508,510 | A | 9/1924 | Edwards | |

(Continued)

FOREIGN PATENT DOCUMENTS

| | | |
|---|---|---|
| DE | 871579 | 3/1953 |
| DE | 29816558 | 11/1997 |

(Continued)

OTHER PUBLICATIONS

English translation of German Pat. No. DE 871 579.

(Continued)

*Primary Examiner* — Hadi Shakeri
(74) *Attorney, Agent, or Firm* — Gardner, Linn, Burkhart & Flory, LLP

(57) ABSTRACT

A hand operated gripping tool comprises a first jaw unit having a workpiece engaging portion, a second jaw unit having a workpiece engaging portion and being movable relative to the first jaw unit such that a variable size workpiece receiving space is defined between the workpiece engaging portions and a handle for applying a force to the second jaw unit. The second jaw unit is engagable with a reaction surface such that, in use, in response to a force applied by the handle, the workpiece engaging portion is forced against a workpiece received in the workpiece receiving space. An elongate extension portion extends from the workpiece engaging portion. The lever arm is connected with the elongate extension portion and the extension portion has a bend promoting portion disposed between the workpiece engaging portion and the lever arm connection that is configured to promote bending of the extension portion.

20 Claims, 12 Drawing Sheets

(56) References Cited

U.S. PATENT DOCUMENTS

| | | | | | |
|---|---|---|---|---|---|
| 1,534,218 | A | | 4/1925 | Jones | |
| 1,867,912 | A | | 2/1931 | Evey | |
| 2,595,368 | A | | 5/1952 | Plautz | |
| 2,913,943 | A | * | 11/1959 | Carlson et al. | 81/412 |
| 3,142,212 | A | * | 7/1964 | Grape | 81/407 |
| 3,222,958 | A | | 12/1965 | Houdesheldt | |
| 3,657,949 | A | | 4/1972 | Myers | |
| 3,862,776 | A | | 1/1975 | Sims et al. | |
| 5,660,089 | A | * | 8/1997 | Chow | 81/413 |
| 5,964,130 | A | * | 10/1999 | Wang | 81/424 |
| 6,065,376 | A | * | 5/2000 | Khachatoorian | 81/407 |
| 6,116,124 | A | | 9/2000 | Ping | |
| D431,435 | S | * | 10/2000 | McCalla et al. | D8/52 |
| 6,155,142 | A | * | 12/2000 | Bally et al. | 81/389 |
| 7,313,989 | B1 | | 1/2008 | Tortolani | |
| 2009/0056510 | A1 | | 3/2009 | Buchanan et al. | |

FOREIGN PATENT DOCUMENTS

| | | |
|---|---|---|
| GB | 18585 | 0/1901 |
| GB | 844 490 | 1/1958 |
| GB | 2072081 | 9/1981 |
| JP | 09001468 | 6/1995 |

OTHER PUBLICATIONS

International Search Report dated Aug. 6, 2007 for PCT Application Ser. No. PCT/GB2007/000745, which corresponds to U.S. Appl. No. 12/281,548, of which the present application is a continuation-in-part.

Search Report for British application Serial No. GB 0908588.7.

Great Britain Search Report for Application No. GB1007513.3.

* cited by examiner

HAND OPERATED GRIPPING TOOL

CROSS REFERENCE TO RELATED APPLICATION

This application claims the priority benefit of UK Application No. 07 21292.1, filed Oct. 30, 2007; and this application is a continuation-in-part of U.S. pat. application, Ser. No. 12/281,548, filed Sep. 3, 2008, which is a 371 of International Application No. PCT/GB2007/000745, filed Mar. 5, 2007, which claims the priority benefit of Ireland Application No. 2006/0158, filed Mar. 3, 2006.

FIELD OF INVENTION

The invention relates to hand operated gripping tools and particularly to hand operated gripping tools that are adjustable to any size of workpiece within the range of the jaws of the tool. One form of hand operated gripping tool to which the invention is particularly applicable is pliers of the type generally referred to as water pump pliers or slip joint pliers.

BACKGROUND TO THE INVENTION

Existing water pump pliers have the common characteristic of jaws offset at an angle to the pliers' handles and a pivot post, in the form of a bolt or rivet, mounted in the area rearward of the jaw on one of the handles and projecting through an elongate slot on the other handle. In such pliers, means for enabling selective spacing of the distance between the jaws may take the form of spaced apart ridges or teeth provided along the inside long edge of the slot and adapted for incremental selective binding engagement with the pivot post. Another well known way of providing distance adjustment between the jaws in such pliers is to provide spaced apart arcuate ridges on the facing surfaces of the slot for engagement by the pivot post. All such tools require a two-handed operation to adjust the jaw spacing the size of a workpiece to be gripped between the jaws. This adjustment involves pulling the handles apart to permit the pivot post to slide along the slot to move the movable one of the jaws to a position that provides a jaw spacing approximating to the size of the workpiece that is to be gripped.

Other known types of pliers are adapted to slideably close upon a workpiece in response to manual closing of the handles and, in response to contact with the workpiece, automatically lock against further sliding action by engaging suitable teeth and thereby shift from a sliding to a pivoting mode whereby continued exertion of manual force on the handles increases the gripping action upon the workpiece.

The gripping action of the known pliers is a function of the relationship between the length of the operating handles and the length of the jaws from the pivot post, which is typically in a ratio of around 5:1. The result is that a considerable portion of the torque applied to the operating handles is required to grip the workpiece, meaning there is often insufficient torque available to shift a tight workpiece.

In certain circumstances it would be a considerable advantage to be able to lock pliers upon a workpiece. The known pliers are unable to include this function.

Another drawback of the known pliers is that the pivot post fixing action, whether by spaced apart ridges, teeth or arcuate ridges in the slot, is such that the jaws/handles are seldom in an optimum position prior to the shift from sliding to a pivoting mode. This results in a variable gripping action upon the workpiece.

SUMMARY OF THE INVENTION

The invention provides a hand operated gripping tool comprising a first jaw unit having a workpiece engaging portion, a second jaw unit having a workpiece engaging portion and movable relative to said first jaw unit such that a variable size workpiece receiving space is defined between said workpiece engaging portions and a handle for applying a force to said second jaw unit, said second jaw unit being engageable with a reaction surface such that, in use, in response to said force applied by said handle the workpiece engaging portion thereof is forced against a workpiece received in said workpiece receiving space and comprising an elongate extension portion extending from said workpiece engaging portion, said lever arm being connected with said elongate extension portion at a connection location and said extension portion having a bend promoting portion disposed between said workpiece engaging portion and said connection location which bend promoting portion is configured to promote limited bending of the extension portion in a direction away from said first jaw unit in response to a reaction force generated by engagement with the workpiece between said first and second jaw units.

The invention also includes a hand operated gripping tool comprising a first jaw unit, a second jaw unit, a first cam associated with said first jaw unit, a pivotal handle for applying an operating force to said first jaw unit and a second cam associated with said pivotal handle, said first and second jaw units being cooperable to define a variable size space for receiving a workpiece and said first and second cams being operable in response to an operating force to cause said first and second jaw units to grip the workpiece that is positioned in said variable size space, at least one of said first and second jaw units comprising a flexure promoting portion configured to promote flexure of the jaw unit away from said variable size space in response to a reaction force generated by the workpiece gripped between said first and second jaw units in said variable size space.

The invention also includes a hand operated gripping tool comprising a first jaw, a second jaw cooperable with said first jaw to define a variable size workpiece receiving space, a support on which said first jaw is slideable for varying the size of said workpiece receiving space and a pivotable lever, said first jaw and said pivotable lever each being provided with engagement portions for engaging respective parts on said support such that pivoting movement of said lever in one direction causes said first jaw to move against a workpiece that is positioned in said workpiece receiving space at least substantially in contact with said first and second jaws so as to grip the workpiece and said first jaw being configured to permit limited bending movement away from said workpiece receiving space in response to a reaction force generated by the workpiece gripped between said first and second jaw unit in said workpiece receiving space.

BRIEF DESCRIPTION OF THE DRAWINGS

In order that the invention may be well understood, some embodiments thereof, which are given by way of example only with reference to the drawings in which.

DETAILED DESCRIPTION OF THE ILLUSTRATED EMBODIMENTS

Figure 1:
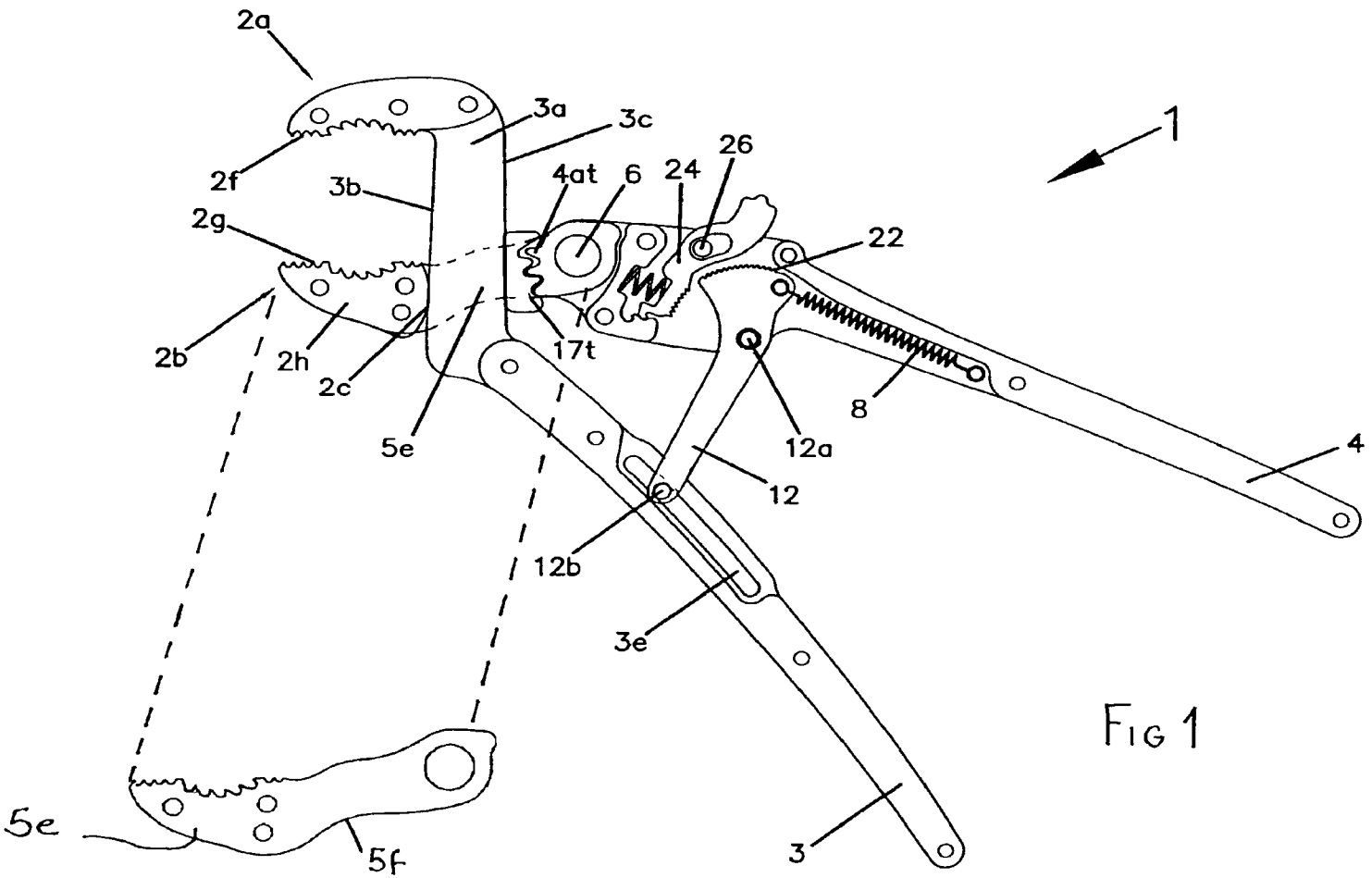
FIG. 1 shows a first embodiment of a hand operated gripping tool with certain laminations removed and an automatic locking device of the tool in an operative, but unlocked condition.

In the following description of the illustrated embodiments of a hand operated gripping tool, like parts of the tool will be referred to by the same reference numbers.

FIGS. 1 to 4 illustrate a first embodiment of a hand operated gripping tool in the form of pliers 1. The pliers 1 comprise a fixed jaw unit 2*a*, a movable jaw unit 2*b*, a fixed handle 3 and a pivotal handle 4. Each jaw unit 2*a*, 2*b* has a workpiece engaging portion provided with jaw gripping profiles 2*g*, 2*f*. The movable jaw unit 2*b* can be moved relative to the fixed jaw unit 2*a* by operation of the pivotal handle 4 to provide a variable size workpiece receiving space between the jaw gripping profiles 2*g*, 2*f*. The jaw units 2*a*, 2*b*, fixed handle 3 and pivotal handle 4 can be laminate structures. In FIGS. 1 to 4, the uppermost (as viewed in the drawings) laminations have been removed to reveal internal features of the pliers 1.

The fixed jaw unit 2*a* is connected with a support member 3*a* for the movable jaw 2*b*. The support member 3*a* extends transverse to the fixed jaw unit 2*a* (in this embodiment the jaw support member extends approximately perpendicular to the fixed jaw unit). The movable jaw unit 2*b* is able to slide along the support member 3*a* to vary the size of the workpiece receiving space. The support member 3*a* defines a first clamp, or reaction surface 3*b* and a second clamp, or reaction surface 3*c*. The first and second clamp surfaces 3*b*, 3*c* are disposed in oppositely facing spaced apart relation. The fixed handle 3 is connected with an end of the support member 3*a* such that the support member extends between and connects the fixed handle 3 to the fixed jaw unit 2*a*.

Figure 2:
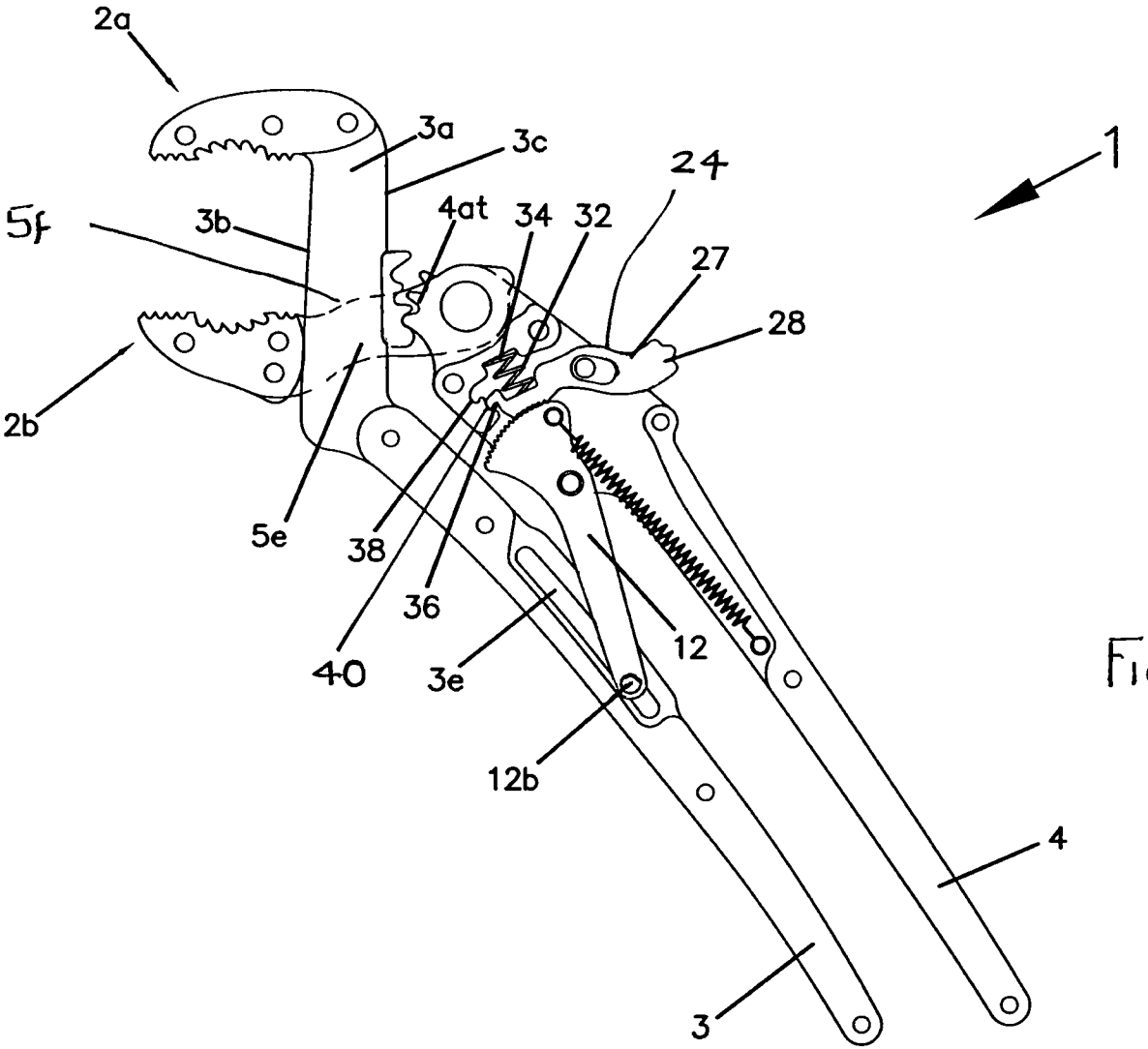
FIG. 2 shows the first embodiment with certain laminations removed and the automatic locking device in a locking condition.
Figure 3:
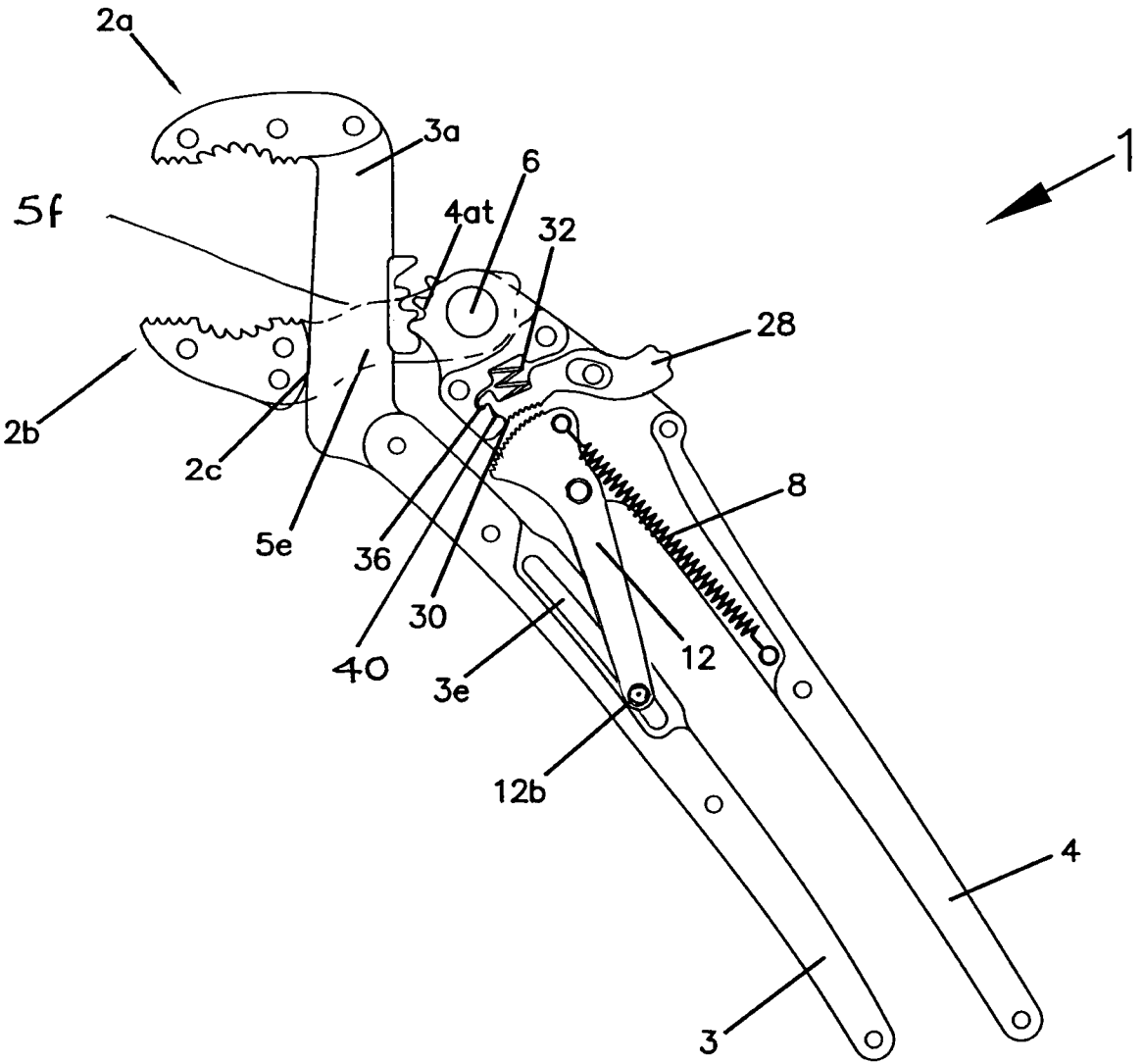
FIG. 3 shows the first embodiment with certain laminations removed and the automatic locking device in withdrawn non-operative condition.

The movable jaw unit 2*b* is a laminate structure comprising a jaw center member 2*h* and an extension portion comprising two elongate link members 5*e*. In FIGS. 1 to 3, the uppermost link member 5*e* (as viewed in the drawings) has been removed to reveal internal features of the pliers 1. The movable jaw unit 2*b* comprises a cam surface 2*c*, which is defined by the jaw center member 2*h* and is engageable with the first clamp surface 3*b*. The link members 5*e* are attached to the sides of a jaw center member 2*h* such that the jaw center member is sandwiched between the link members. The portions of the link members 5*e* that are attached against the sides of the jaw center member 2*h* are shaped to correspond to the profile of the jaw center member and so include jaw gripping profiles 2*f*, 2*g*. The link members 5*e* extend from the jaw center member 2*h* and are disposed in opposed spaced apart relation to define a gap therebetween. The support member 3*a* extends through the gap defined between the link members 5*e*. A pivotal handle 4 is pivotally connected with movable jaw unit 2*b* by means of a pivot pin 6 at a connection location adjacent the respective free ends of the link members 5*e*.

Figure 4:
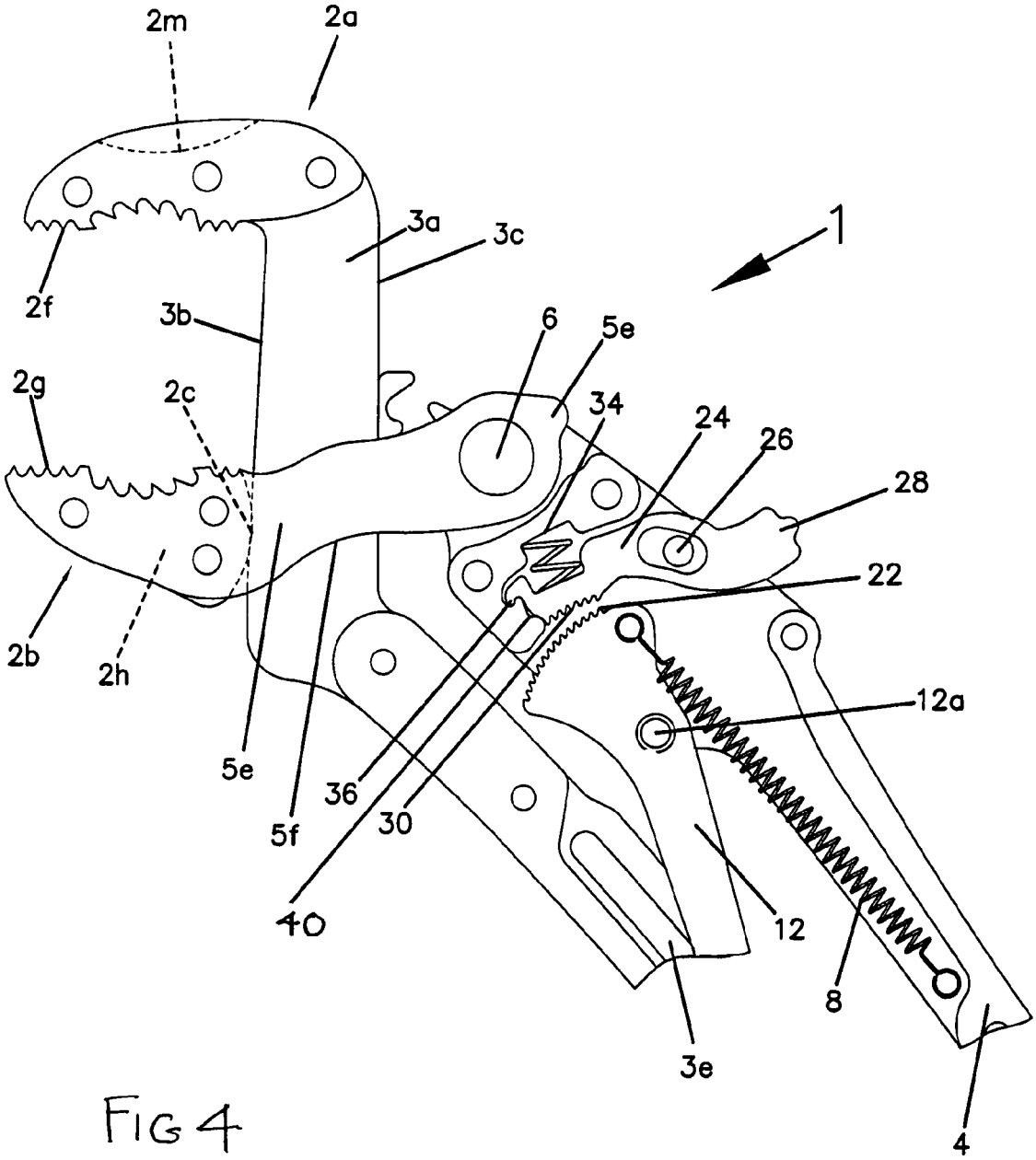
FIG. 4 is an enlargement of a portion of FIG. 3 showing a movable jaw unit in greater detail.

As best seen in FIG. 4, the link members 5*e* comprise a bend, or flexure, promoting portion 5*f*. When the movable jaw unit 2*b* is assembled to the support member 3*a*, the bend promoting portion 5*f* is disposed between the first clamp surface 3*b* and the connection location at which the pivotable handle 4 is connected to the movable jaw unit 2*b* by the pivot pin 6. Specifically, in the illustrated embodiment the bend promoting portion 5*f* extends between the cam surface 2*c* and second clamp surface 3*c*. The bend promoting portion 5*f* comprises a bowed, or corrugated, section that is bowed in the general direction of the fixed jaw unit 2*a*. The bowing is in the plane of the link members 5*e*.

As best seen in FIG. 1, the pivotal handle 4 is provided with a toothed pivotal handle cam 4 at, which is positioned on the pivotal handle adjacent the pivot pin 6 such that when the pivotal handle pivots on the pivot pin, the cam 4 at pivots about the axis of the pivot pin. The teeth of the toothed pivotal handle cam 4 at engage a toothed slip shoe 17*t* that engages and is slideable along the second clamp surface 3*c*.

A pivotal link 12 extends between the fixed handle 3 and pivotal handle 4. The pivotal link 12 is pivotally connected to the fixed handle 3 by a pivot pin 12*b* that is slideably received in a slot 3*e* defined in the fixed handle 3. The slot 3*c* extends in the lengthways direction of the fixed handle 3 and when the uppermost (as viewed in the drawing) lamination of the handle is in place, cannot be seen. The pivotal link 12 is pivotally connected to the pivotal handle 4 by a pivot pin 12*a*. A biasing member in the form of a tension spring 8 is connected to the pivot pin 12*a* and a location on the pivotal handle 4 and is arranged to bias the pivotal handle to the position shown in FIG. 1. In FIG. 1, the pliers are shown in a fully open condition in which the workpiece receiving space defined between the jaw units 2*a*, 2*b* is at its maximum extent.

The pliers 1 are provided with an automatic locking device that comprises teeth 22 provided on the end of the pivotal link 12 adjacent the pivot pin 12*a* and a locking member 24. The locking member 24 is pivotally mounted on the pivotal handle 4 on a pivot pin 26. The pivot pin 26 is fixed to the pivotal handle 4 and extends through a lengthways extending slot 27 (FIG. 2) provided in the locking member 24. The locking member 24 has a thumb tab 28 for actuation by a user of the pliers 1. When the uppermost lamination of the pivotal handle 4 is in place, the thumb tab 28 is the only portion of the locking member 24 that is visible.

Referring particularly to FIGS. 2 and 4, at the end of the locking member 24 opposite the thumb tab 28, the side of the member facing away from the pivotal handle pin 6 is provided with teeth 30 for engaging the teeth 22 on the pivotal link 12. On the other side of the locking member 24 opposite the teeth 30, there is a recess that houses an end of a resilient member, which in this embodiment is compression spring 32. The opposite end of compression spring 32 is held in a recess 34 provided in the pivotal handle 4. As best seen in FIG. 4, the toothed end of the locking member 24 is provided with a nose-like projection 36 that engages in recesses 38, 40 provided in the pivotal handle 4 to locate the locking member 24 in its inoperative and operative positions respectively. The compression spring 32 biases the locking member 24 to the operative position shown in FIGS. 1 and 2 in which the projection 36 engages in the recess 40 and the member is able to automatically engage the teeth 22 provided on the end of the pivotal link 12. When the projection 36 is engaged in the recess 38, the locking member is held in a withdrawn position in which it cannot engage with the pivotal link 12. Thus, the locking member 24 can be locked in a withdrawn inoperative position. This means that, when desired, the pliers 1 can be used without the automatic locking device. When a user wishes to activate the automatic locking device, the thumb tab 28 is used to slide the locking member 24 outwardly with respect to the pivotal handle 4 to withdraw the projection 36 from the recess 38. Once the projection 36 is clear of the recess 38, the compression spring 32 acts against the toothed end of the locking member to move the locking member to the operative position shown in FIGS. 1 and 2 in which it is ready to automatically engage the pivotal link 12.

In FIG. 2, the teeth 30 on the locking member 24 are shown engaging the teeth 22 on the pivotal link 12, thereby locking the jaw units 2*a*, 2*b* in the position shown. The teeth 22, 30 are shaped such that as the pivotal link 12 pivots from the position shown in FIG. 1 to the position shown in FIG. 2, they automatically engage in the manner of a ratchet. The biasing force provided by the compression spring 32 presses the teeth 30 into the teeth 22, thereby ensuring that locking engagement is maintained.

The lock can be released by pushing down (as viewed in FIG. 2) on the thumb tab 28 to cause the toothed end of the locking member 24 to pivot clockwise to release the pivotal link 12 and allow free movement of the pivotal handle 4 relative to the fixed handle 3. When the thumb tab 28 is released, the toothed end of the locking member 24 is returned to the position shown in FIG. 1 so that the locking member is ready to automatically engage the teeth 22 of the pivotal link 12.

The bend or flexure promoting portion 5*f* has been found to provide advantages in the operation of the pliers 1. It will be appreciated that when the movable jaw unit 2*b* engages a workpiece trapped between the jaw gripping profiles 2*f*, 2*g*, it can require a considerable force input from the user to force the moveable jaw unit 2*b* hard into the workpiece so that the teeth 22 on the pivotal link 12 fully engage the teeth 30 on the locking member 24. This is particularly so if the jaw units 2*a*, 2*b* and workpiece are made of a hard material and are rigid. Where the respective parts are hard and rigid, there is a risk of the teeth 22, 30 not fully engaging and the lock slipping. By providing a limited flexure, or bending, of the workpiece engaging portion of the movable jaw unit 2*b* away from the workpiece, as additional force is applied to the pivotal handle 4 by the user, sufficient additional movement of the handle is available to ensure full engagement of the teeth 22, 30. This makes achieving locking easier for the user and reduces the stresses on the movable jaw.

Referring to FIG. 4, an optional recess, or cut-out, 2*m* is shown provided in the fixed jaw unit 2*a*. This allows additional flexure of the jaw units 2*a*, 2*b* to further reduce the user input force needed to lock the jaw units 2*a*, 2*b* in firm engagement with a workpiece.

It will be appreciated that the configuration of the bend promoting portion 5*f* and, when provided, the recess 2*m* can be varied considerably to provide the degree of flexure required. For example, the bend promoting portion of 5*f* comprises a single bow or arch directed in the general direction of the workpiece receiving space. It is envisaged that further arches, undulations or corrugations in the plane of the link members 5*e* could by provided. It will also be appreciated that the degree of allowed bending should be relatively small; otherwise, the pliers 1 will not be able to provide a satisfactory gripping action. The degree of flexure required and allowable for satisfactory operation on the pliers 1 can readily be determined by experiment.

Optionally, the first and second clamp surfaces 3*b*, 3*c* provided on the support member 3*a* are not parallel. Instead, the first clamp surface 3*b* tapers towards the second clamp surface 3*c* as the two surfaces approach the fixed jaw 2*a*. This tapering of the support member 3*a* is shown in FIG. 4. The wedge effect this provides causes the movable jaw unit cam 2*c* to act more quickly and to lock better. This also allows the jaw angle to be less likely to result in a partial closure when gripping a thin workpiece as the thinning of the support member 3*a* towards the fixed jaw unit 2*a* can cancel out the effect of any rotation of the toothed pivotal handle cam 4 at against the toothed shoe 17.

Figure 5:
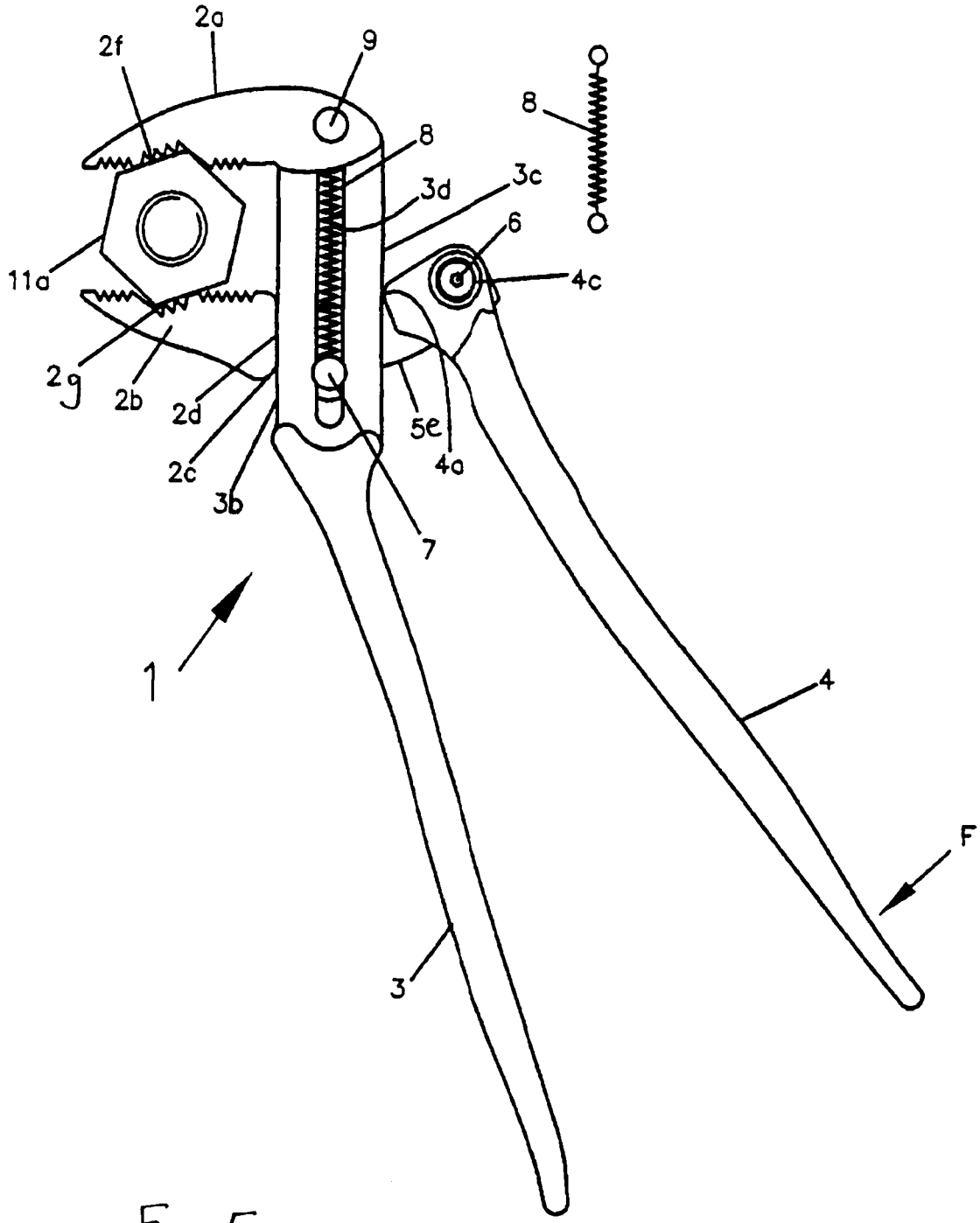
FIG. 5 shows a second embodiment of a hand operated gripping tool gripping a fastener-type workpiece with a lamination of a jaw unit removed to reveal internal parts of the tool.

FIG. 5 illustrates a second embodiment of a hand operated gripping tool in the form of pliers 1. The pliers 1 are shown in a closed condition gripping a fastener-type workpiece between the jaw units 2*a*, 2*b*. The uppermost (as viewed in the drawing) link member 5*e* has been omitted to reveal internal parts of the pliers 1.

In the second embodiment, the support member 3*a* extends generally perpendicular to the first jaw unit 2*a* and has first and second clamp surfaces 3*b*, 3*c* that are disposed in substantially parallel spaced apart relation. A slot 3*d* extends in the lengthways direction of the support member 3*a*. A slide pin 7 extends through the slot 3*d* generally perpendicular to the plane of the support member 3*a* and is held in respective bushes provided in the link members 5*e*. The slide pin 7 is able to slide along the slot 3*d* as the second jaw unit 2*b* slides along the support member 3*a*. A resilient member in the form of a tension spring 8 is housed within the slot 3*d*. One end of the spring 8 is secured to the fixed jaw 2*a* by a spring post 9. The opposite end of the resilient member 8 is secured to the slide pin 7. The spring 8 pulls the second jaw unit 2*b* towards the first jaw unit 2*a* such that that pliers 1 are biased towards a closed condition and will provide a light clamping force on the workpiece 11*a* prior the application a force F to the pivotal handle 4.

The pivotal handle 4 is provided with an integral cam 4*a* that acts against the second clamp surface 3*c* of the support member 3*a* to cause rotation of the cam 2*c* of the second jaw unit 2*b* against the first clamp surface 3*b*. The pivotal arm 4 is also provided with respective stop surfaces 4*d* arranged to be engageable with stops 5*d* that project from the link members 5*e* and serve to limit movement of the pivotal handle 4 away from the fixed handle 3.

There now follows a description of five further embodiments of a hand operated gripping tool in the form of pliers 1 that in each case comprise a bend, or flexure, promoting feature in one or both of the two jaw units. These embodiments show how the flexure promoting concept can be incorporated into various configurations of hand operated gripping tool and the description of them will provide further illustration of the functioning of the first embodiment.

Figure 6:
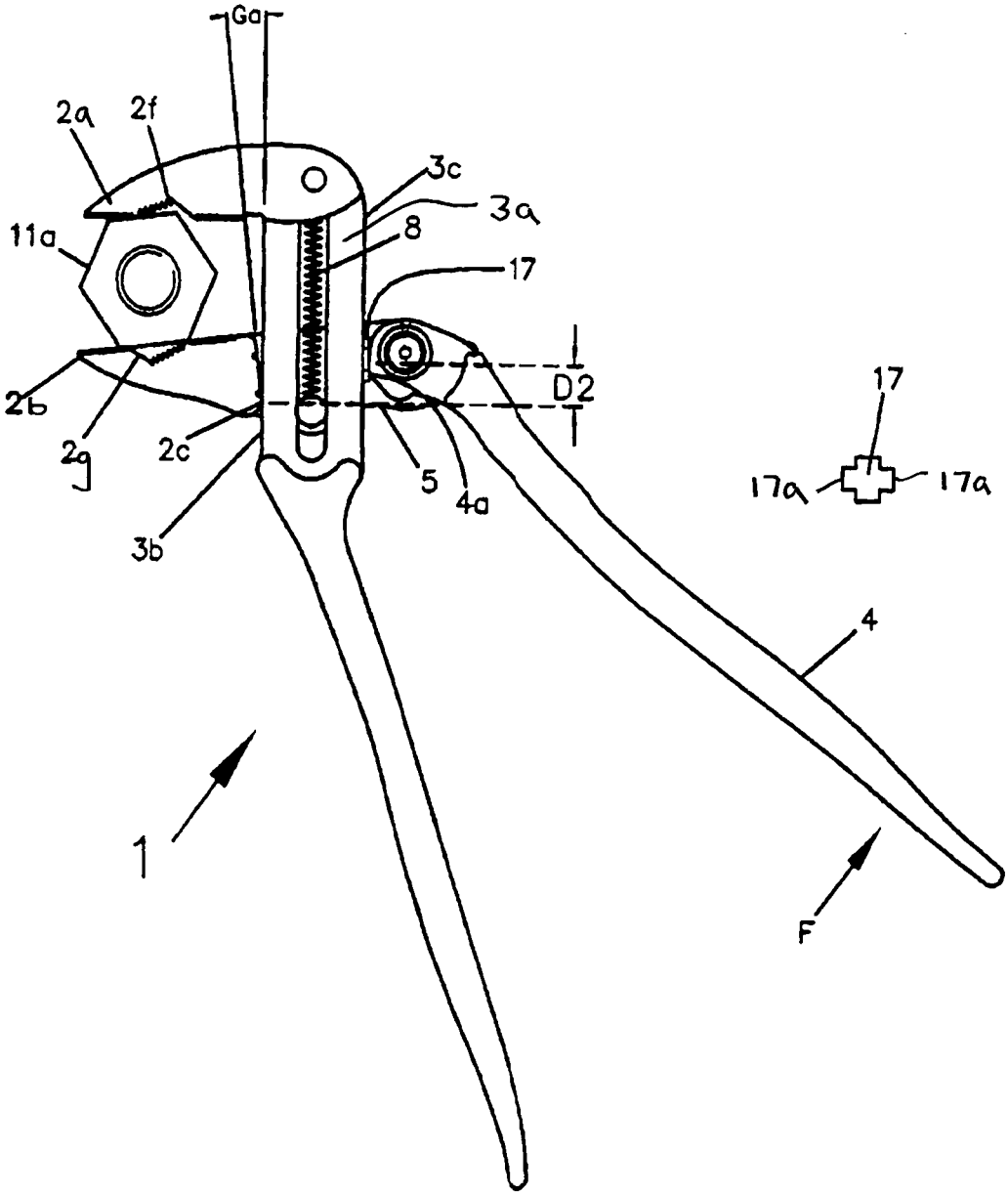
FIG. 6 shows a third embodiment of a hand operated gripping tool in a relaxed open condition loosely holding a fastener-type workpiece with a lamination of a jaw unit removed to reveal internal parts of the tool.
Figure 7:
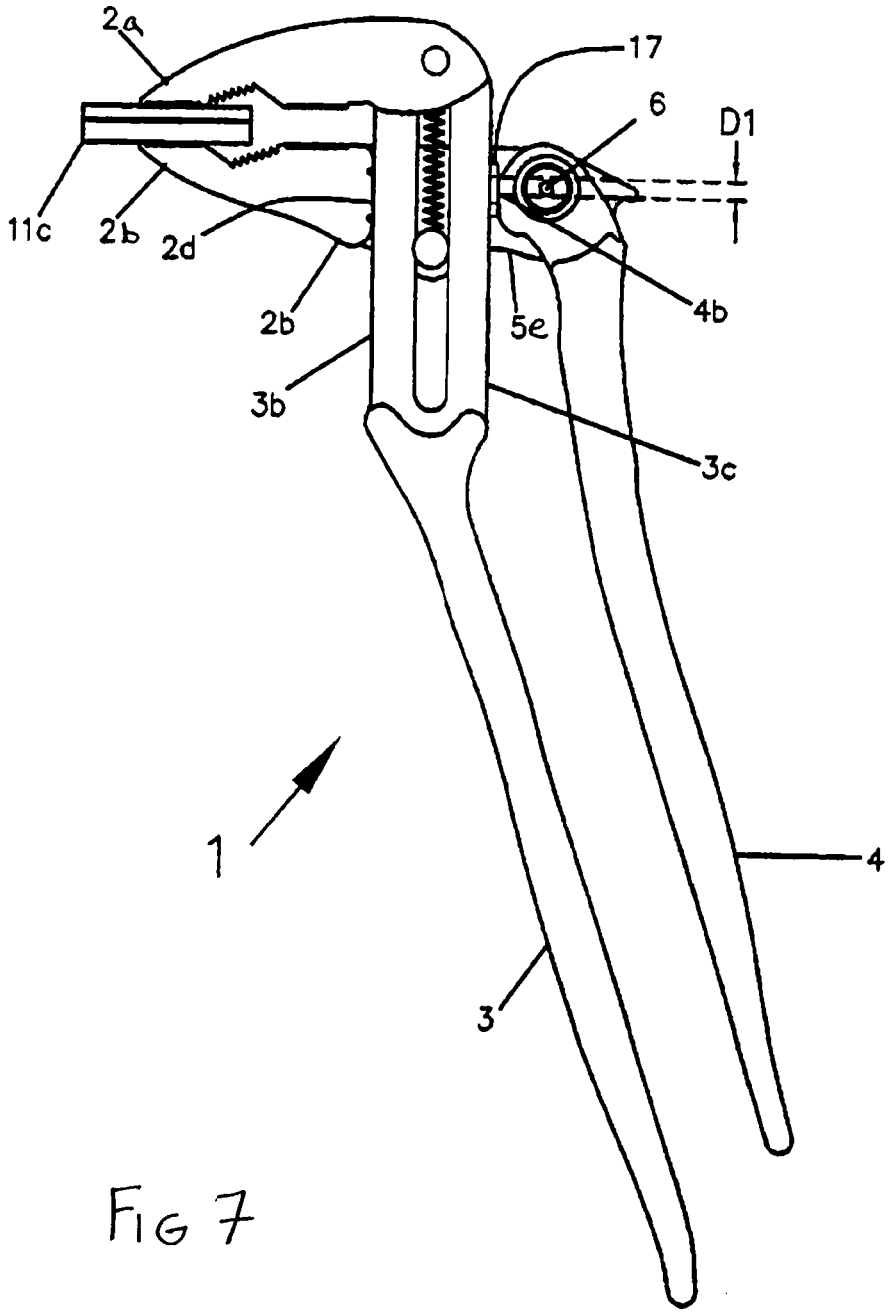
FIG. 7 shows the third embodiment in a locked condition with a top lamination of a link arm removed in order to reveal the internal parts of the tool.

FIGS. 6 and 7 show a third embodiment of a hand operated gripping tool in the form of pliers 1 with the uppermost (as viewed in the drawing) link arm 5*e* removed in order to show internal parts of the tool.

In FIG. 6, the pivotal handle 4 is shown in a fully opened position. In this position the cam 4*a* on the pivotal handle 4 has been moved out of engagement with the slip shoe 17 and the cam surface 2*c* is spaced from the first clamp surface 3*b* (see the gap Ga). In this condition of the pliers 1, it is only necessary to overcome the tension of the resilient member 8 in order to rotate the jaw units 4*a*, 4*b* to allow the jaw gripping profiles 2*e*, 2*f* to be repositioned upon the workpiece 11*a*.

The slip shoe 17 is shown to be in the form of a cross. The slip shoe 17 is held between the cam 4*a* on the pivotal handle 4 and the second clamp surface 3*c* by the arms 17*a* of the slip shoe engaging in respective slots (not shown) in the link members 5*e*. The slip shoe 17 is thus constrained to move with the movable jaw unit 2*b* as it slides on the support member 3*a*.

The cam-to-cam distance D2 between the cams 4*a*, 2*c* is indicated.

FIG. 7 shows the third embodiment with the pivotal handle in the fully closed position and the jaws units 2*a*, 2*b* clamping a workpiece 11*c* in the form of two plate-like members. The movement of the pivotal handle 4 to the fully closed position has rotated the cam 4*a* past the slip shoe to bring a locking surface 4*b* has into firm contact with the second clamp surface 3*c* via the slip shoe 17. The operation of the clamp 4*a* on the pivotal handle has moved the movable jaw unit 2*b* on the cam surface 2*c* to bring a locking portion 2*d* of the movable jaw unit 2*b* into engagement with the first clamp surface 3*b* above the center of the pivot pin 6 a distance D1. This arrangement prevents the pivotal handle 4 from moving outwards with respect to the fixed handle 3 unless manually moved in that way. This locks the pliers 1 in the closed position gripping the workpiece 11*c*.

Figure 8:
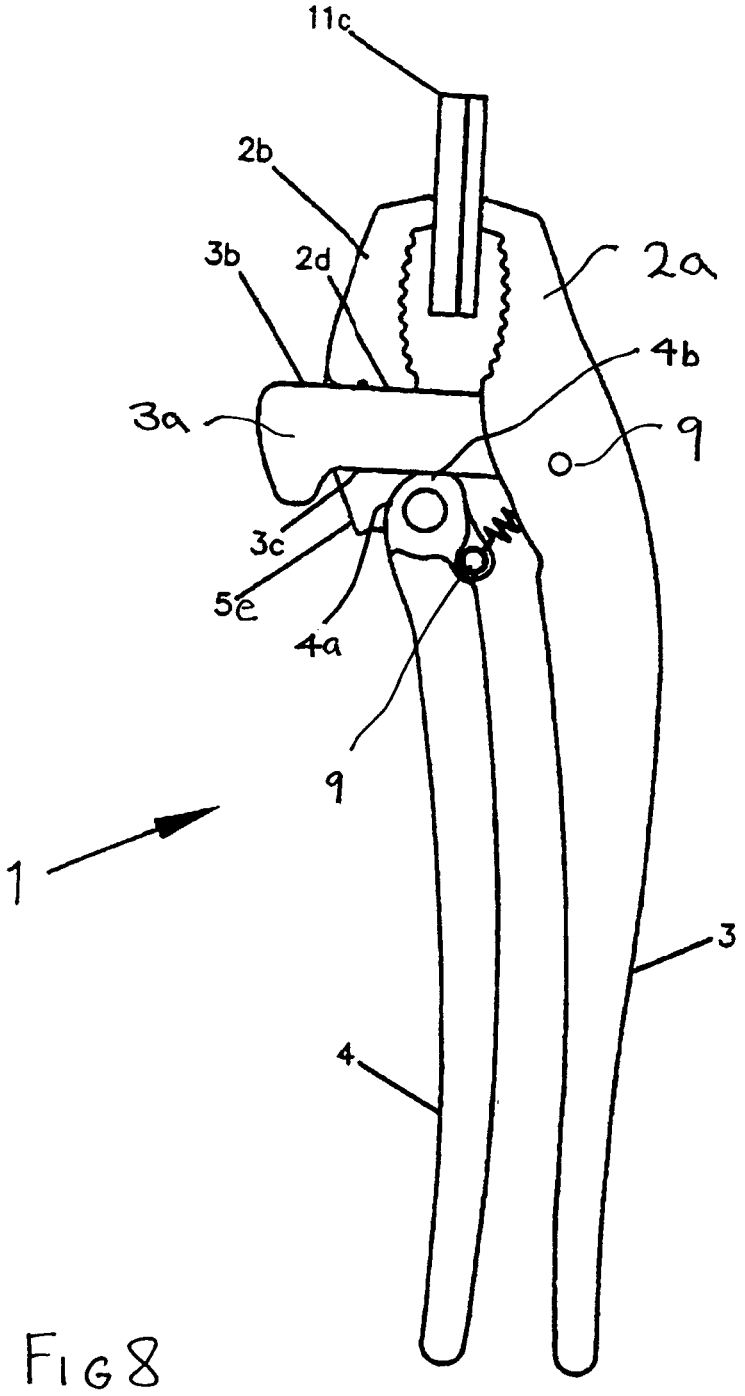
FIG. 8 shows a fourth embodiment of a hand operated gripping tool clamping two plates together and with a link member removed to reveal internal parts of the tool.

FIG. 8 is a plan view of the fourth embodiment of a hand operated gripping tool in the form of pliers 1. Again, an uppermost (as viewed in the drawing) link member 5*e* of the movable jaw unit 2*b* has been omitted to show internal features of the pliers 1.

In this embodiment the fixed handle 3 is joined directly to the fixed jaw unit 2*a*. The resilient member 8 is not within an elongate slot in the support arm 3*a*. Instead, it is held between respective spring posts 9 fitted to the fixed jaw unit 2*a* and movable jaw unit 2*b*. The resilient member 8 is arranged to bias the movable jaw unit 2*b* towards the fixed jaw unit 2*a* and position the cam 4*a* on the pivotal handle 4 against the second clamp surface 3*c* when the pliers 1 is in a rest position. In this embodiment, there is no slip shoe, so the cam 4*a* bears directly against the second clamp surface 3*c*.

In FIG. 8, the pivotal handle 4 is shown moved fully towards the fixed handle 3, resulting in a locking portion 4*b* of the pivotal handle 4 being brought into full contact with the second clamp surface 3*c* so that the jaw units 2*a*, 2*b* are clamped onto the workpiece 11*c*.

Figure 9:
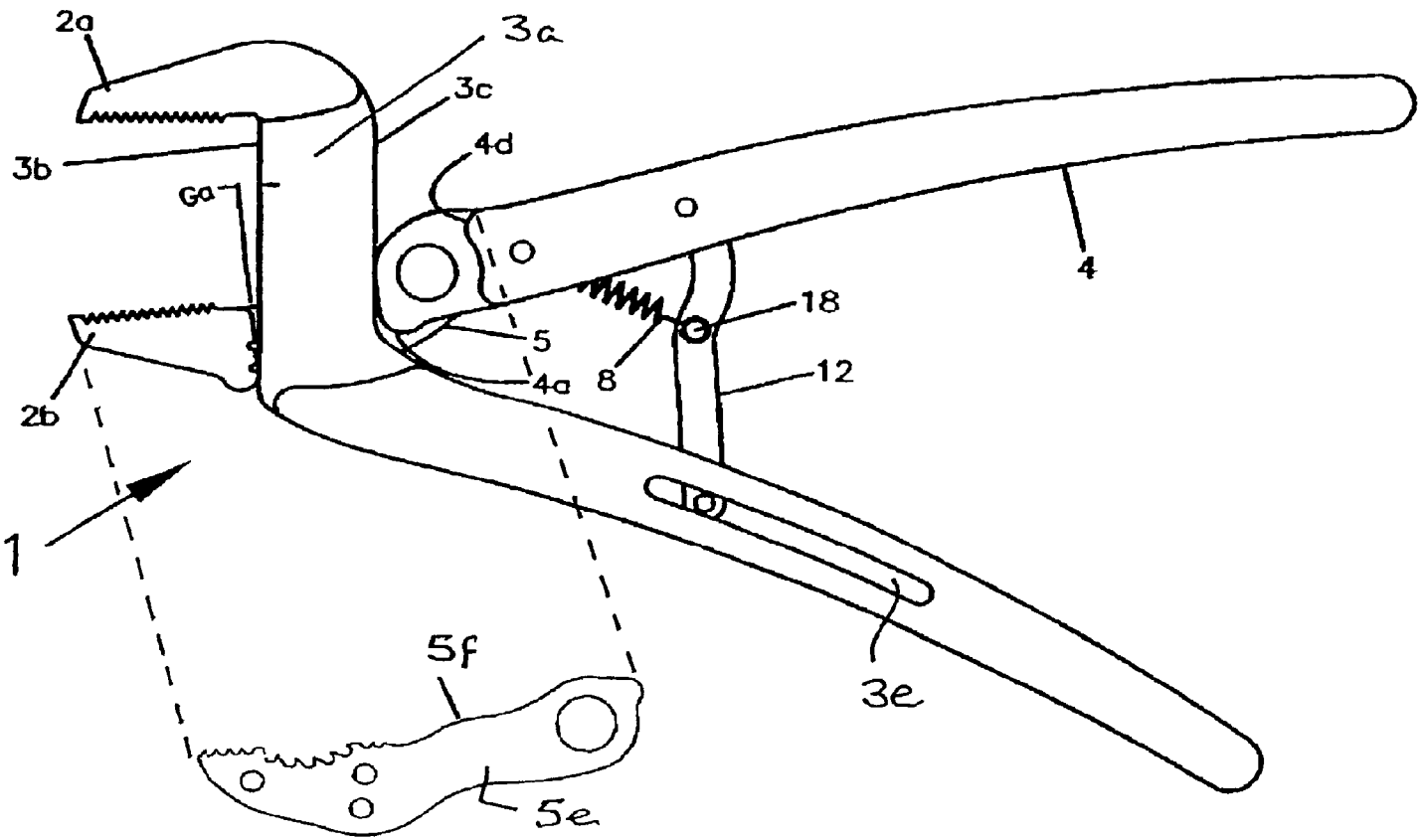
FIG. 9 shows a fifth embodiment of a hand operated gripping tool with link member removed in order to reveal internal parts of the tool.
Figure 10:
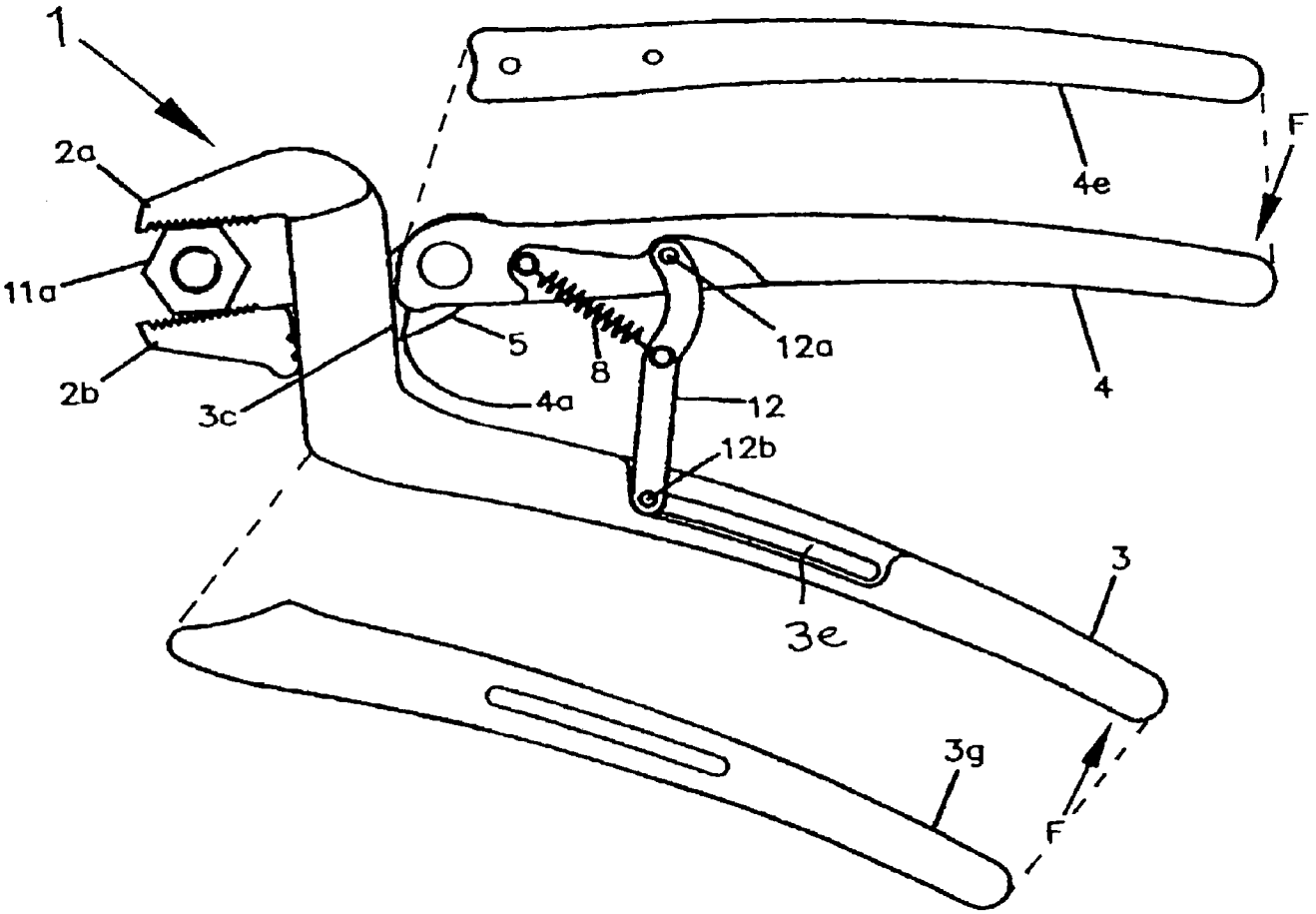
FIG. 10 shows the fifth embodiment partially operated with its jaw units coming against a workpiece.
Figure 11:
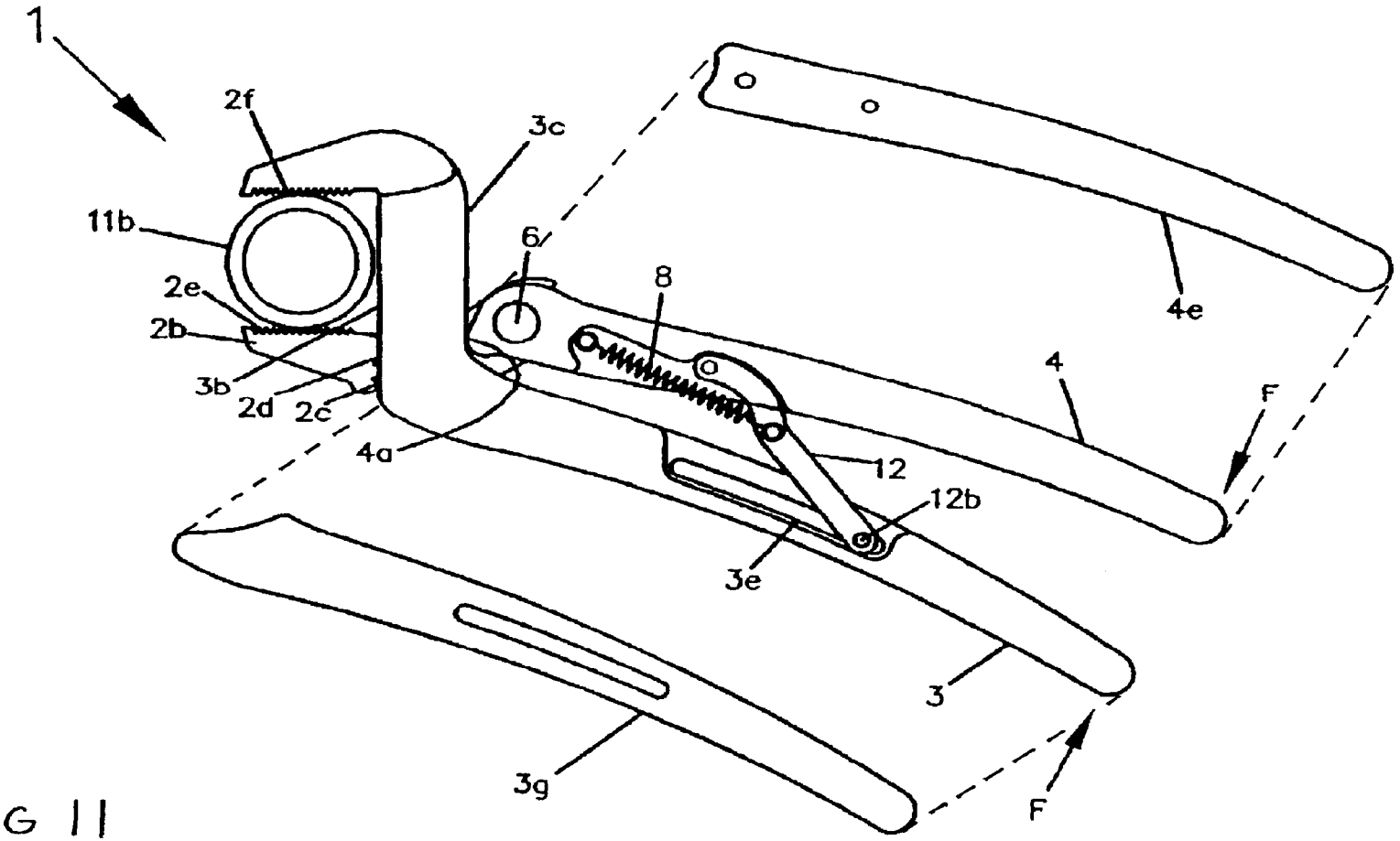
FIG. 11 shows the fifth embodiment in another operating position and gripping a different workpiece.

FIGS. 9 to 11 show a fifth embodiment of a hand operated gripping tool in the form of pliers 1. In FIGS. 10 and 11 the fixed handle top laminate 3*g*, pivotal handle top laminate 4*e* and top link member 5*e* are shown removed.

In FIG. 9 the pliers 1 are shown at rest. The resilient member 8 is acting on the pivotal handle 4 and pivotal link 12 to urge the movable jaw unit 4*b* down the support member 3*a* away from the fixed jaw unit 2*a*. This moves the cam surface 2*c* off the first clamp surface 3*b* to open a gap Ga. A stop 4*d* on the pivotal handle 4 acts against a stop 5*d* on the link member 5*e* to limit the movement of the pivotal handle. The cam 4*a* on the pivotal handle 4 is off of the second clamp surface 3*c*.

In FIG. 10 the pivotal handle 4 is shown pushed towards the fixed handle 3 by a force F that causes it to pivot around the pivotal link 12 against the resistance of the resilient member 8 until the movement is arrested by the jaw units 2*a*, 2*b* coming against a workpiece 11*a*. During this part of the movement the initial engagement of the cam 4*a* on the pivotal handle 4 with the second clamp surface 3*c* causes no effective clamping action on the fastener 11*a*.

In FIG. 11 the pivotal handle 4 and pivotal links are shown in a fully operated position causing the jaw units 2*a*, 2*b* to clamp on a tubular workpiece 11*b*. The force F applied to the pivotal handle 4 has caused the pivot pin 12*b* to travel down the slot 3*e* in the fixed handle 3, thereby extending the resilient member 8. This allows the pivotal handle 4 to rotate around the pivot pin 6 causing the cam 4*a* on the pivotal handle to act on the second clamp surface 3*e*. This action rotates the movable jaw unit 2*b* on the cam surface 2*c* driving the locking portion 2*d* towards the first clamp surface 3*b* further improving the gripping action of the jaw units 2*a*, 2*b* on the workpiece 11*b*. This allows considerable torque to be applied to the rotation of the workpiece 11*b*, whilst a reduced force F is required to ensure the jaw units 2*a*, 2*b* continue to grip the workpiece 11*b*.

Figure 12:
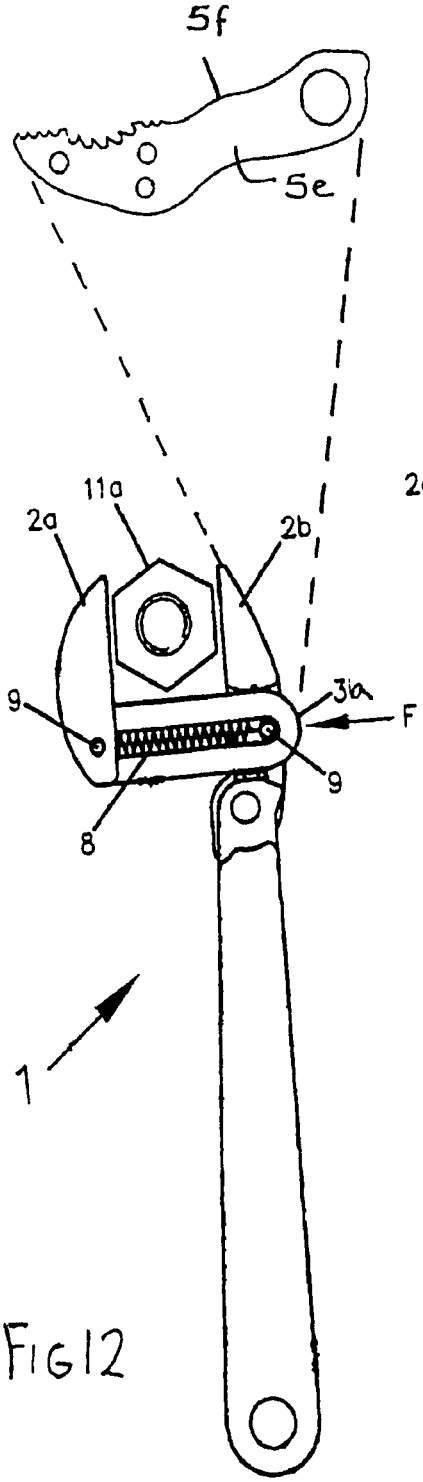
FIG. 12 shows a sixth embodiment of a hand operated gripping tool opened to receive a fastener and with a link member removed to reveal internal parts of the tool.
Figure 13:
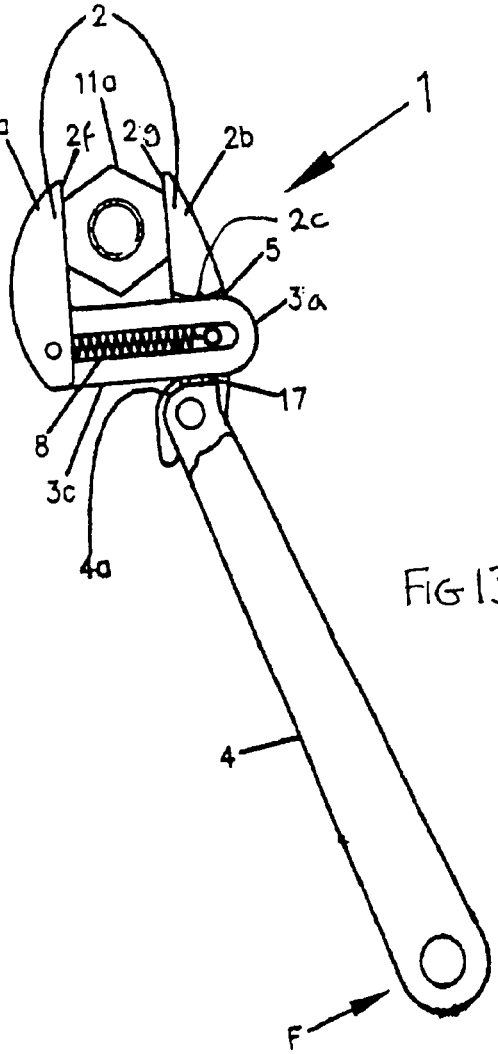
FIG. 13 is a view of the sixth embodiment corresponding to FIG. 12 but showing the tool clamped onto a workpiece.

FIGS. 12 and 13 illustrate a sixth embodiment of a hand operated gripping tool in the form of pliers 1. The uppermost (as viewed in the drawings) link member 5*e* is shown removed to reveal internal parts of the pliers 1. In this embodiment, there is no fixed handle 3.

As illustrated in FIG. 12 the jaw units 2*a*, 2*b* are shown opened by applying an axial force F to the support member 3*a* to move the fixed jaw unit away from the movable jaw unit 2*b*. The axial force F acts against the biasing force of the resilient member 8, which is held between respective spring posts 9 fixed to the jaw units 2*a*, 2*b*. When the axial force F is removed, the resilient member 8 pulls the jaw units 2*a*, 2*b* to lightly clamp a workpiece 11*a* between the jaw units.

Referring to FIG. 13, a force F applies a torque to the pivotal handle 4 to cause the cam 4*a* on the pivotal handle to act on the second clamp surface 3*c* via a slip shoe 17. This causes the movable jaw unit 2*b* to pivot on the cam surface 2*c* to provide a firm grip on the workpiece 11*a*.

The embodiments shown in FIGS. 5 to 8 have a fixed jaw unit 2*a* that is attached to a fixed handle 3 via an elongate support member 3*a* and a movable jaw unit 2*b* that is attached via one or more link members 5*e* to a pivotal handle 4 such that it can slide and pivot relative to the fixed jaw 2*a*. The support member 3*a* is an elongate bar with parallel oppositely facing clamp surfaces 3*b*, 3*c*, although, as shown in FIG. 4, the support member may taper towards the fixed jaw unit. With the pivotal handle 4 in the open position, the movable jaw unit 2 and pivotal handle 4 are free to slide to and fro along the support member 3*a*. There is an elongate slot 3*d* within the support member 3*a* containing a resilient member in the form of an extension spring 8 that has one end attached to the movable jaw unit 2*b* by a slide pin 7 and the other end attached to the fixed jaw unit 2*a* by a spring post 9*a*. The extension spring 8 acts to urge the two jaw units 2*a*, 2*b* towards a closed position. To open the jaw units 2*a*, 2*b*, the pivotal handle 4 is manually moved away from the fixed handle 3 and propelled along the elongate bar 3*a* to allow a workpiece 11 to enter between the jaw units 2*a*, 2*b*. Releasing the pivotal handle 4 allows the spring 8 to close the jaw units 2*a*, 2*b* on the workpiece 11. Manual activation of the pivotal handle 4 towards the fixed handle 3 then brings the cam 4*a* on the pivotal handle into contact with the second clamp surface 3*c* on the support member 3*a* to cause the movable jaw 2*b* to pivot on the cam surface 2*c* of the movable jaw unit 2*b* against the first clamp surface 3*b*. The pivotal handle 4 has a cam locking portion 2*d* that can be moved into engagement with the support member 3*a* at a location positioned above the cam surface 2*c* (i.e. nearer to the fixed jaw unit 2*a*). The grip between the jaw units 2*a*, 2*b* and the workpiece 11 is increased as the cam 4*a* is rotated against the second clamp surface 3*c* causing the movable jaw unit 2*b* to rotate towards the fixed jaw unit until the locking portion 2*d* comes into contact with the first clamp surface 3*b*. Provided the cam 4*a* on the pivotal handle 4 is suitably proportioned and has sufficient force exerted upon it by the actuation of the pivotal handle 4 towards the fixed handle 3, the workpiece 11 will be firmly clamped between the jaw units 2*a*, 2*b*. The degree of clamping action on the workpiece 11 will be directly related to the gripping action angle Ga or movable jaw 2*b* rotation on the cam surface 2*c* until the locking portion 2*d* is clamped against the first clamp surface 3*b*. In use, this can result in additional force being exerted outwardly upon the jaw units 2*a*, 2*b*. This force is a result of the geometry of the movable jaw unit 2*b*, cam surface 2*c*, locking portion 2*d*, cam 4*a* and the locking portion 4*b* and will correspondingly increase the clamping action upon the clamp surfaces 3*b*, 3*c* of the support member 3*a*. Given appropriate handles 3, 4, jaw unit 2*a*, 2*b* and cam 2*c*, 4*a* proportions, a ratio of over 12:1 handle to jaw closure leverage is achievable.

The pliers 1 can be manually operated by the operation of the pivotal handle 4 only. The grip on the workpiece 11 can be increased by manually increasing the force F applied between the pivotal and fixed handles 3, 4. The gripping function can be released by reversing the operating direction of the pivotal handle 4 (i.e. moving it away from the fixed handle 3) until gripping force of the jaw units 2*a*, 2*b* on the workpiece 11 is approximately that of the extension spring 8. This makes it possible to reposition the pliers on the workpiece in a manner similar to a ratchet wrench.

A further locking function can be incorporated in the pliers 1 by the provision of a generally flat locking portion or portions 4*b* adjacent to the cam 4*a* on the pivotal handle 4 such that movement of the cam 4*a* past the second clamp surface 3*c* brings the locking portion or portions 4*b* into engagement with the clamping surface. Provided the locking portion 4*b* engages the second clamp surface 3*c* past a point equivalent to a right angle from the clamp surface 3*c* through the center point of the pivot pin 6 (the cam lock distance D1), the jaw units 2*a*, 2*b* will remain locked on the workpiece 11 until the pivotal handle 4 is manually operated away from the fixed handle 3.

In some embodiments, in order to minimise the overall size of the pliers 1, the layout of the handles 3, 4 can be reversed, resulting in the cam 4*a* on the pivotal handle 4 acting upon the outer clamp surface 3*c* possibly causing the jaw units 2*a*, 2*b* to partially release their grip upon the workpiece 11. To overcome this potential problem, a slip shoe 17 can be provided. The slip shoe 17 can be retained within apertures in the link members 5*e* to ensure it is correctly positioned between the cam 4*a* and the second clamp surface 3*c*. In use the cam 4*a* then slips on the smooth surface of the slip shoe 17.

The embodiment shown in FIGS. 9 to 11 incorporates a pivotal link 12 between the fixed and movable handles 3, 4. A resilient member 8 pulls the pivotal link 12 to a position in which its movable end and the associated pivot pin 12*a* are at the end of the slot 3*e* in the fixed handle that is closest to the jaw units. This holds the jaws in the open position shown in FIG. 9. Initial operation of the handles 3, 4 from the position shown in FIG. 9 results in the pivotal handle 4 pivoting around the pivot link and pivot pin 12*a*, rapidly closing the jaw units 2*a*, 2*b* onto the workpiece 11 until the jaw units 2*a*, 2*b* abut the workpiece 11. Continued operation of the pivotal handle 4 forces the movable end of the pivotal link 12 and the associated pivot pin 12*b* along the slot 3*e* against the return force generated in the resilient member 8. This allows the pivotal handle 4 to rotate further towards the fixed handle 3. Moving the pivotal handle 4 towards the fixed handle 3 causes the cam 4*a* to act on the second clamp surface 3*c*. The movable jaw unit 2*b* then pivots on the cam surface 2*c*, further closing the jaw units 2*a*, 2*b* onto the workpiece 11 and ensuring the workpiece is sufficiently gripped prior to using the pliers on the workpiece.

As shown in FIGS. 12 and 13, a fixed handle 3 is not necessarily required, provided the resilient member 8 is strong enough to ensure closure of the jaw units 2*a*, 2*b* against a workpiece 11 during the initial actuation of the pivotal handle 4 until the cam 4*a* has sufficient grip on the second clamp surface 3*c* to allow movable jaw unit 2*b* to pivot on the cam surface 2*c*.

The geometrical proportions of the pliers 1 can be varied to suit many different applications and gripping forces.

It will be appreciated that conventional hand operated gripping tools are designed too rigid and strong and, in particular, the jaw units are not designed to flex away from the workpiece. By providing a designed weakening of one or both jaw units that actually promotes a limited bending away from the workpiece, and so away from the other jaw unit, it is possible to ensure that a locking function of the tool fully engages, even when the tool is being clamped onto a hard rigid workpiece. Thus a reliable clamping action can be achieved.

It will be appreciated that the or each jaw unit that is provided with a bend promoting portion should be made of a material (typically a steel) that is sufficiently resilient to cope with the bending without being permanently deformed or otherwise damaged by it.

Embodiments of the invention include a set of pliers for applying a torque to rotate fasteners, pipes/tubes and the like and especially for the operation of plumbing-type fittings. The pliers preferably include a locking function. Preferably, the locking function can be used to provide a 'vice grip' type clamping action that can be used for the purpose of gripping or clamping in a locking manner many differing shapes, materials or fasteners.

It will be appreciated that the gripping mechanism of the invention is not limited to pliers as shown in the embodiments. For example, the present invention could be advantageously applied to the clamping and locking mechanism of bar clamps used in such fields as carpentry.

The invention claimed is:

1. A hand operated gripping tool comprising:

a fixed jaw unit having a first workpiece engaging portion;

a support member extending transversely with respect to said fixed jaw unit, said support member defining a first reaction surface and a second reaction surface disposed opposite and facing away from said first reaction surface and having a first end disposed closest to said fixed jaw unit and a second end disposed furthest from said fixed jaw unit;

a movable jaw unit having a second workpiece engaging portion and a cam surface engagable with said first reaction surface and being slidable relative to said fixed jaw unit on said support member such that a variable size workpiece receiving space is defined between said first and second workpiece engaging portions;

a fixed handle connected with said second end of said support member;

a movable handle provided with a cam to apply a force to said second jaw unit via said second reaction surface, said cam surface being engagable with said first reaction surface such that, in use, in response to the force applied by said movable handle said movable jaw unit turns on said first reaction surface so that said second workpiece engaging portion is forced against a workpiece received in said workpiece receiving space;

a pivotal link pivotally connected to said fixed handle and said movable handle and provided with a slide pin that is slidable in a slot defined by said fixed handle;

an automatic locking device for locking said movable jaw unit to fix the size of said workpiece receiving space, said automatic locking device comprising a locking member movable between a withdrawn non-operative position and an operative position to be engagable by said pivotal link to lock said movable jaw unit; and an elongate extension portion extending from said second workpiece engaging portion and provided with a pivot member aperture, wherein said movable handle is connected with said elongate extension portion by a pivot member received in said pivot member aperture, said pivot member aperture is positioned such that said support member extends between said cam surface and said pivot member and said second reaction surface faces and is spaced from said pivot member, said cam and cam surface are arranged such that when said movable handle applies said force to said second reaction surface said cam surface engages said first reaction surface at a position further from said first end and closer to said second end than a position at which said force is applied to said second reaction surface, and wherein said extension portion has a bend promoting portion disposed between said second workpiece engaging portion and said pivot member aperture, wherein said bend promoting portion is configured to promote limited bending of said extension portion in a direction away from said fixed jaw unit in response to a reaction force generated by engagement with the workpiece between said fixed and movable jaw units to permit movement of said pivotal link to engage said locking member.

2. A hand operated gripping tool as claimed in claim 1, wherein said bend promoting portion comprises a section that is bowed transverse to a lengthways direction of the extension portion.

3. A hand operated gripping tool as claimed in claim 2, wherein said extension portion comprises at least one planar member and said bowed section is bowed in a plane of the extension portion.

4. A hand operated gripping tool as claimed in claim 2, wherein said bowed section arches towards said first jaw unit.

5. A hand operated gripping tool as claimed in claim 1, wherein said bend promoting portion is disposed between said first and second reaction surfaces.

6. A hand operated gripping tool as claimed in claim 1, wherein said extension portion comprises two elongate members disposed in opposed spaced apart relation, each said elongate member comprising a said bend promoting portion.

7. A hand operated gripping tool as claimed in claim 1, wherein said first reaction surface comprises a first side surface of said support member that faces into said workpiece receiving space and said second reaction surface comprises a second side surface of said support member that is disposed opposite and spaced from said first side surface, the spacing between said first and second side surfaces decreasing as said first and second side surfaces approach said fixed jaw unit.

8. A hand operated gripping tool as claimed in claim 1, wherein said cam causes said movable jaw unit to engage said first reaction surface.

9. A hand operated gripping tool as claimed in claim 1, further comprising a biasing device arranged to bias said locking member to an operative position.

10. A hand operated gripping tool as claimed in claim 1, wherein said locking member is provided with formations for cooperably engaging formations provided on said pivotal link.

11. A hand operated gripping tool as claimed in claim 1, wherein in said direction away from said fixed jaw unit said elongate extension portion is unsupported between said cam surface and said pivot member aperture.

12. A hand operated gripping tool comprising:

a movable jaw unit;

a fixed jaw unit;

a cam surface associated with said movable jaw unit;

a pivotal handle for applying an operating force to said movable jaw unit and a cam associated with said pivotal handle;

a fixed handle;

a support member extending transversely with respect to said fixed jaw unit between said fixed jaw unit and said fixed handle, wherein said movable jaw unit is slidable on said support member to vary the size of a workpiece receiving space defined between said movable and fixed jaw units, said support member having an end adjoining said fixed jaw unit, a first side surface facing into said workpiece receiving space and a second side surface facing away from said workpiece receiving space; and an automatic locking device for locking said movable jaw unit to fix the size of said workpiece receiving space, said locking device comprising a locking member mounted on said pivotal handle and a pivotal link that is pivotally connected to said fixed handle and said pivotal handle, said automatic locking device locking by engagement of said pivotal link with said locking member;

wherein said cam surface and said cam operate on said first and second side surfaces, respectively, in response to the operating force to cause said fixed and movable jaw units to grip a workpiece that is positioned in said workpiece receiving space, said cam surface and said cam are configured such that when operating on said first and second side surfaces said cam surface operates on said first side surface at a position disposed further from said end of said support member than a position at which said cam operates on said second side surface;

wherein said movable jaw unit comprises a flexure promoting portion configured to promote flexure of said movable jaw unit away from said workpiece receiving space in response to a reaction force generated by the workpiece when gripped between said fixed and movable jaw units in said workpiece receiving space, wherein said flexure of said flexure promoting portion permits movement of said pivotal handle to engage said pivotal link with said locking member subsequent to gripping by said fixed and movable jaws of a workpiece that is received in said workpiece receiving space; and wherein said movable jaw unit comprises a connection portion between said cam surface and said pivotal handle and said flexure promoting portion is defined by said connection portion said flexure promoting portion defining a fulcrum about which said movable jaw unit can flex from said workpiece receiving space.

13. A hand operated gripping tool as claimed in claim 12, wherein said fixed jaw unit comprises a further flexure promoting portion, said further flexure promoting portion comprising a recess provided in an outer side surface of said fixed jaw unit that faces away from said workpiece receiving space and configured to permit flexure of said fixed jaw unit away from said workpiece receiving space.

14. A hand operated gripping tool comprising:

a movable jaw unit;

a fixed jaw unit;

a cam surface associated with said movable jaw unit;

a fixed handle;

a pivotal handle pivotable towards said fixed handle to apply an operating force to said movable jaw unit and a cam associated with said pivotal handle;

a support member extending transversely with respect to said fixed jaw unit between said fixed jaw unit and said fixed handle, wherein said movable jaw unit is slidable on said support member to vary the size of a workpiece receiving space defined between said movable and fixed jaw units, said support member having an end adjoining said fixed jaw unit, a first side surface facing into said workpiece receiving space and a second side surface facing away from said workpiece receiving space; and an automatic locking device actuated by movement of said pivotal handle to automatically lock said movable jaw when said pivotal handle is moved in said direction towards said fixed handle beyond a locking position;

wherein said cam surface and said cam operate on said first and second side surfaces, respectively, in response to the operating force to cause said fixed and movable jaw units to grip a workpiece that is positioned in said workpiece receiving space;

wherein said movable jaw unit comprises a flexure promoting portion configured to promote flexure of said movable jaw unit away from said workpiece receiving space in response to a reaction force generated by the workpiece when gripped between said fixed and movable jaw units in said workpiece receiving space, said flexure of said movable jaw permitting movement of said pivotal handle towards said fixed handle subsequent to gripping of said workpiece to ensure movement beyond said locking position; and wherein said movable jaw unit comprises a connection portion between said cam surface and said pivotal handle and said flexure promoting portion is defined by said connection portion, said flexure promoting portion defining a fulcrum about which said movable jaw unit can flex away from said workpiece receiving space.

15. A hand operated gripping tool as claimed in claim 14, wherein said connection portion is connected to said pivotal handle by a pivot pin and said connection portion is unsupported between said cam surface and said pivot pin.

16. A hand operated gripping tool as claimed in claim 14, wherein said flexure promoting portion comprises a bowed section that is bowed transverse to a lengthways direction of said connection portion.

17. A hand operated gripping tool as claimed in claim 16, wherein said connection portion comprises at least one planar member and said bowed section is bowed in a plane of said planar member.

18. A hand operated gripping tool as claimed in claim 16, wherein said bowed section arches towards said fixed jaw unit.

19. A hand operated gripping tool as claimed in claim 14, wherein said fixed jaw unit comprises a further flexure promoting portion, said further flexure promoting portion comprising a recess provided in an outer side surface of said fixed jaw unit that faces away from said workpiece receiving space and configured to permit flexure of said fixed jaw unit away from said workpiece receiving space.

20. A method of manufacturing pliers, said method comprising:

providing a fixed jaw connected with a fixed handle by a support member;

providing a movable jaw unit pivotally connected with a movable handle and having a movable jaw that is movable along said support member to vary a variable size workpiece receiving space defined between said fixed jaw and said movable jaw;

providing a cam surface on said movable jaw to engage a first reaction surface defined by said support member;

providing said movable handle with a cam to apply a force to a second reaction surface defined by said support member so that when said movable handle is moved towards said fixed handle said cam surface turns on said first reaction surface so that said movable jaw is forced against a workpiece received in said workpiece receiving space;

providing a link member pivotally connected with said movable handle and said fixed handle;

providing a locking member on said movable handle to be automatically engaged by said link member when said movable handle is moved towards said fixed handle beyond a locking position to lock said movable handle and fix the size of said variable size workpiece receiving space;

providing said movable jaw unit with a flexure portion configured to permit flexure of said movable jaw unit away from said fixed jaw in response to a reaction force generated by engagement with said workpiece to permit movement of said movable handle beyond said locking position to lock said movable handle; and wherein said movable jaw unit comprises a connection portion between said cam surface and said pivotal handle and said flexure promoting portion is defined by said connection portion, said flexure promoting portion defining a fulcrum about which said movable jaw unit can flex away from said workpiece receiving space.

* * * * *

UNITED STATES PATENT AND TRADEMARK OFFICE

CERTIFICATE OF CORRECTION

PATENT NO. : 8,561,506 B2
APPLICATION NO. : 12/261525
DATED : October 22, 2013
INVENTOR(S) : Nigel Alexander Buchanan and Seamus Duffy It is certified that error appears in the above-identified patent and that said Letters Patent is hereby corrected as shown below:

In the Specification

Column 4:
Line 30, “4 at,” should be --4at,--
Line 32, “4 at” should be --4at--
Line 34, “4 at” should be --4at--
Line 39, “3c” should be --3e--

Column 6:
Line 22, “4 at” should be --4at--

Column 8:
Line 14, “3e” should be --3c--

In the Claims

Column 11:
Line 42, Claim 2, “the” should be --said--
Line 46, Claim 3, “the” should be --said--
Line 49, Claim 4, “first” should be --fixed--

Column 12:
Line 63, Claim 12, Insert --away-- after “flex”

Signed and Sealed this
Fifth Day of May, 2015

Michelle K. Lee

Michelle K. Lee
*Director of the United States Patent and Trademark Office*